US010571851B2

(12) United States Patent
Ishihara

(10) Patent No.: US 10,571,851 B2
(45) Date of Patent: Feb. 25, 2020

(54) CLEANING UNIT ENABLING ADJUSTMENT OF CONTACT PRESSURE OF A CLEANING BLADE

(71) Applicant: CANON KABUSHIKI KAISHA, Tokyo (JP)

(72) Inventor: Shotaro Ishihara, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/372,713

(22) Filed: Apr. 2, 2019

(65) Prior Publication Data

US 2019/0324395 A1 Oct. 24, 2019

(30) Foreign Application Priority Data

Apr. 24, 2018 (JP) ..... 2018-083498

(51) Int. Cl.
*G03G 21/00* (2006.01)

(52) U.S. Cl.
CPC . *G03G 21/0029* (2013.01); *G03G 2221/0005* (2013.01)

(58) Field of Classification Search
CPC ..... G03G 21/0011; G03G 21/0029
USPC ..... 399/350, 351
See application file for complete search history.

(56) References Cited

U.S. PATENT DOCUMENTS 7,813,691 B2 10/2010 Yoshida
9,031,490 B2 * 5/2015 Ogura ..... G03G 21/0011 399/350

FOREIGN PATENT DOCUMENTS

| | | | |
|---|---|---|---|
| JP | 2007-264602 | A | 10/2007 |
| JP | 2010-169887 | A | 8/2010 |
| JP | 2013-174862 | A | 9/2013 |
| JP | 2014-178351 | A | 9/2014 |

* cited by examiner

*Primary Examiner* — William J Royer
(74) *Attorney, Agent, or Firm* — Venable LLP

(57) ABSTRACT

A cleaning unit includes a case, a blade, a swing member, a first coil spring, a second coil spring, and a plurality of first engaging portions. The first coil spring is provided on a first end side of the blade in the longitudinal direction and configured to pull the swing member. The second coil spring is provided on a second end side of the blade in the longitudinal direction and configured to pull the swing member. The plurality of first engaging portions are provided on one of the case or the swing member at the first end side of the blade and configured to selectively engage a one end side of the first coil spring at different positions with respect to the longitudinal direction of the blade so that a contact pressure of the blade against the image bearing member caused by the first coil spring is changed.

8 Claims, 10 Drawing Sheets

CLEANING UNIT ENABLING ADJUSTMENT OF CONTACT PRESSURE OF A CLEANING BLADE

BACKGROUND OF THE INVENTION

Field of the Invention

The present invention relates to a cleaning unit applicable to an image forming apparatus forming an image on a recording material by an electro-photographic system, an electrostatic recording system or the like to clean an image bearing member.

Description of the Related Art

Hitherto, an electro-photographic image forming apparatus is widely applied as a copier, a printer, a plotter, a facsimile, and a multi-function printer having such plural functions. In the electro-photographic image forming apparatus, a photosensitive member such as a photosensitive drum charged in an exposing process is irradiated with a laser beam to form an electrostatic image and the electrostatic image formed on the photosensitive drum is developed by toner in a developing process. The toner image is then transferred onto a recording material in a transfer process. The toner left on the surface of the photosensitive drum without being transferred onto the recording material among the toner composing the toner image is removed by a cleaning unit. The cleaning unit cleans the surface of the photosensitive drum by removing the toner by bringing a cleaning blade in contact with the surface of the photosensitive drum.

The cleaning blade in which a blade member formed of an elastic member such as rubber is integrated with a blade support member configured to support the blade member is popular. The blade member and the blade support member are integrated by adhesion or integral molding for example. It is necessary to press an edge portion of the blade member against the photosensitive drum with a predetermined blade pressure in order to favorably clean the toner left on the photosensitive drum by the cleaning blade. Here, if the blade pressure is set at a pressure weaker than an adequate pressure, the toner slips through the edge portion of the blade member, possibly causing a so-called toner slip-through phenomenon by which the toner adheres on a surface portion on a side closer to the photosensitive drum among the surface portion on one side in a thickness direction of the blade member. Meanwhile, if the blade pressure is set at a pressure stronger than the adequate pressure, abrasion of the photosensitive drum by the blade member is accelerated, possibly shortening a life of the photosensitive drum.

Lately, in order to improve image quality, small particle toner of around 10 μm or less for example of volume average particle is used. As compared to large particle toner of exceeding 10 μm of volume average particle, the small particle toner receives less friction force from the blade member and the photosensitive drum. Accordingly, because there is a possibility of causing the slip-off of the toner if the blade pressure is not set at the adequate pressure in a case where the small particle toner is used, it is necessary to set the blade pressure in high precision in the case where the small particle toner is used. Then, Japanese Patent Application Laid-open No. 2010-169887 has proposed a configuration provided with a pressing force switching unit of switching the pressing force of the cleaning blade against the photosensitive drum between two different pressing forces of a first pressing force and a second pressing force which is smaller than the first pressing force. This pressing force switching unit is arranged to suppress the slip-off of toner by switching the pressing force of the cleaning blade from the first pressing force to the second pressing force which is smaller than the first pressing force when temperature of the cleaning blade is high. By the way, it is desired to improve accuracy of adjustment, i.e. adjustment resolution, of an adjustment unit in a case where a range of optimum values of the pressing forces of the cleaning blade against the photosensitive drum is narrowed due to prolongation of a life of the cleaning unit and to the decrease of particle size of the toner.

However, an image forming apparatus described in Japanese Patent Application Laid-open No. 2010-169887 requires a driving source for driving the pressing force switching unit, inviting an increase of costs and complexity of the unit. Japanese Patent Application Laid-open No. 2013-174862 discloses a configuration of adjusting a pressure of a cleaning blade against an image bearing member by changing attachment positions of a compression coil spring. This configuration adjusts the blade pressure by changing the attachment position of the compression coil spring in a blade short direction. Therefore, a space for attaching the compression coil spring in the blade short direction is required, possibly increasing the size of the apparatus in the blade short direction.

The present disclosure provides a cleaning unit that can suppress an increase in size in a blade short direction while enabling to adjust a contact pressure of a cleaning blade against an image bearing member with a simple configuration.

SUMMARY OF THE INVENTION

According to one aspect of the present invention, a cleaning unit includes a case, a blade being in contact with a surface of an image bearing member to clean the surface of the image bearing member, a swing member provided swingably around a swinging axial line extended along a longitudinal direction of the blade and configured to support the blade to swing together, a first coil spring provided on a first end side of the blade in the longitudinal direction and configured to pull the swing member to bring the blade into contact with the image bearing member, a second coil spring provided on a second end side of the blade in the longitudinal direction and configured to pull the swing member to bring the blade into contact with the image bearing member, and a plurality of first engaging portions provided on one of the case or the swing member at the first end side of the blade in the longitudinal direction and configured to selectively engage a one end side of the first coil spring at different positions with respect to the longitudinal direction of the blade so that a contact pressure of the blade against the image bearing member caused by the first coil spring is changed.

Further features of the present invention will become apparent from the following description of exemplary embodiments with reference to the attached drawings.

DESCRIPTION OF THE EMBODIMENTS

First Embodiment

A first embodiment of the present disclosure will be described below in detail with reference to FIGS. 1 through 9. A tandem type full-color printer will be described as one exemplary image forming apparatus 1. However, the present disclosure is not limited to the tandem type image forming apparatus 1 and may be another type image forming apparatus. Still further, the image forming apparatus 1 is not limited to be a full color and may be a mono-color image forming apparatus. Or, the present disclosure may be carried out in various uses such as a printer, various printing machines, a copier, a facsimile, a multi-function printer or the like.

Figure 1:
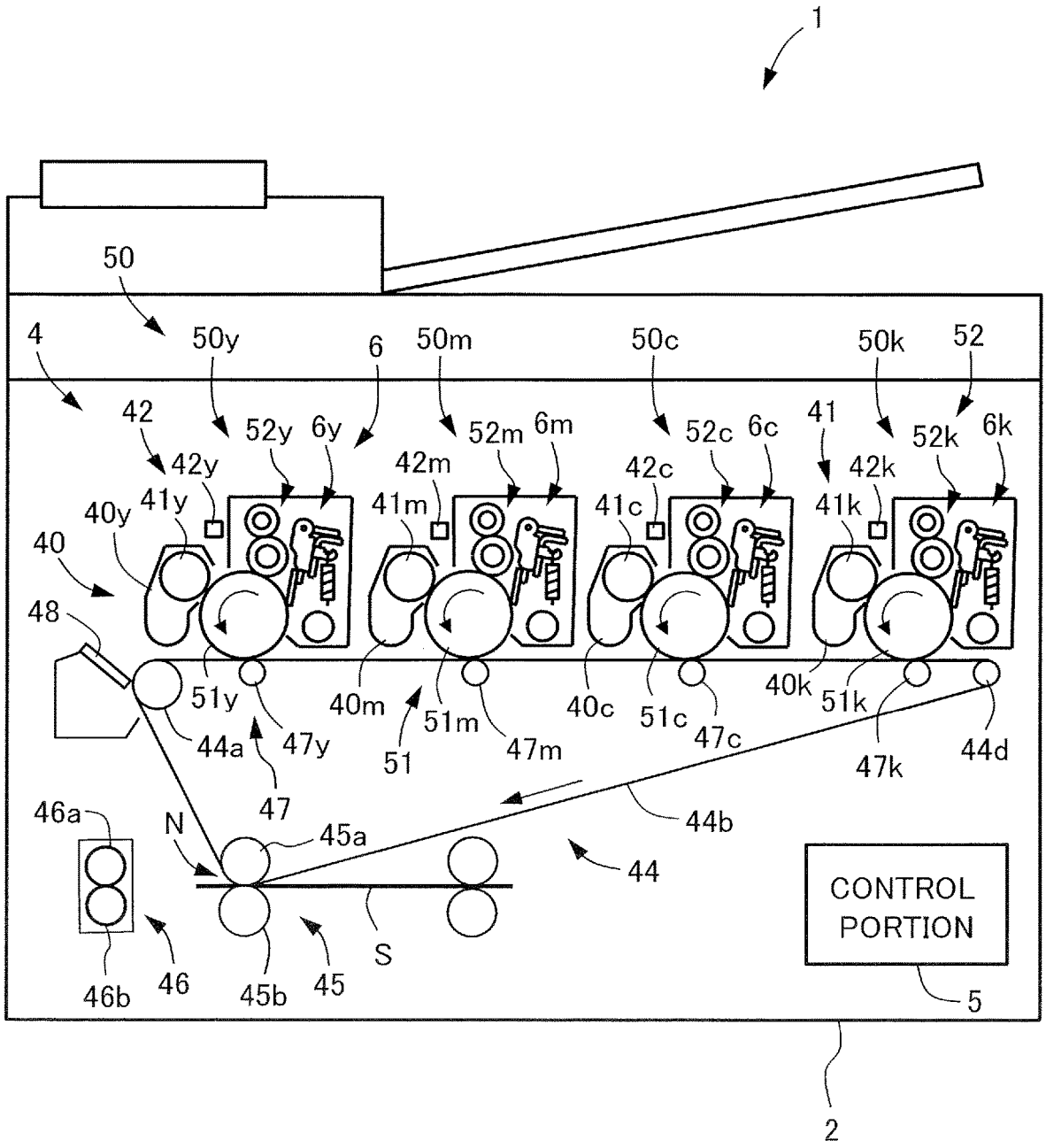
FIG. 1 is a section view illustrating a schematic configuration of an image forming apparatus of a first embodiment.

As illustrated in FIG. 1, the image forming apparatus 1 includes an apparatus body 2, a sheet feeding portion not illustrated, an image forming portion 4, a sheet discharge portion not illustrated and a control portion 5.

The image forming portion 4 can form an image on a sheet S fed from the sheet feeding portion based on image information. The image forming portion 4 includes a drum unit, serving as an image bearing member unit, 50, a toner bottle not illustrated, an exposing unit 42, a developing unit 40, an intermediate transfer unit 44, a secondary transfer portion 45 and a fixing portion 46. Note that the image forming apparatus 1 of the present embodiment corresponds to a full-color printer and is provided with drum units 50*y*, 50*m*, 50*c* and 50*k* each having the same configuration for four colors of yellow (y), magenta (m), cyan (c) and black (k). Exposing units 42 (42*y*, 42*m*, 42*c*, and 42*k*) and developing units 40 (40*y*, 40*m*, 40*c*, and 40*k*) are also provided separately for each of the four colors while having the same configuration. Due to that, while each component of the four colors is denoted with identifiers of colors after a reference numeral thereof in FIG. 1, there may be a case where each component is described only by its reference numeral without the color identifiers on and after FIG. 2.

Figure 2:
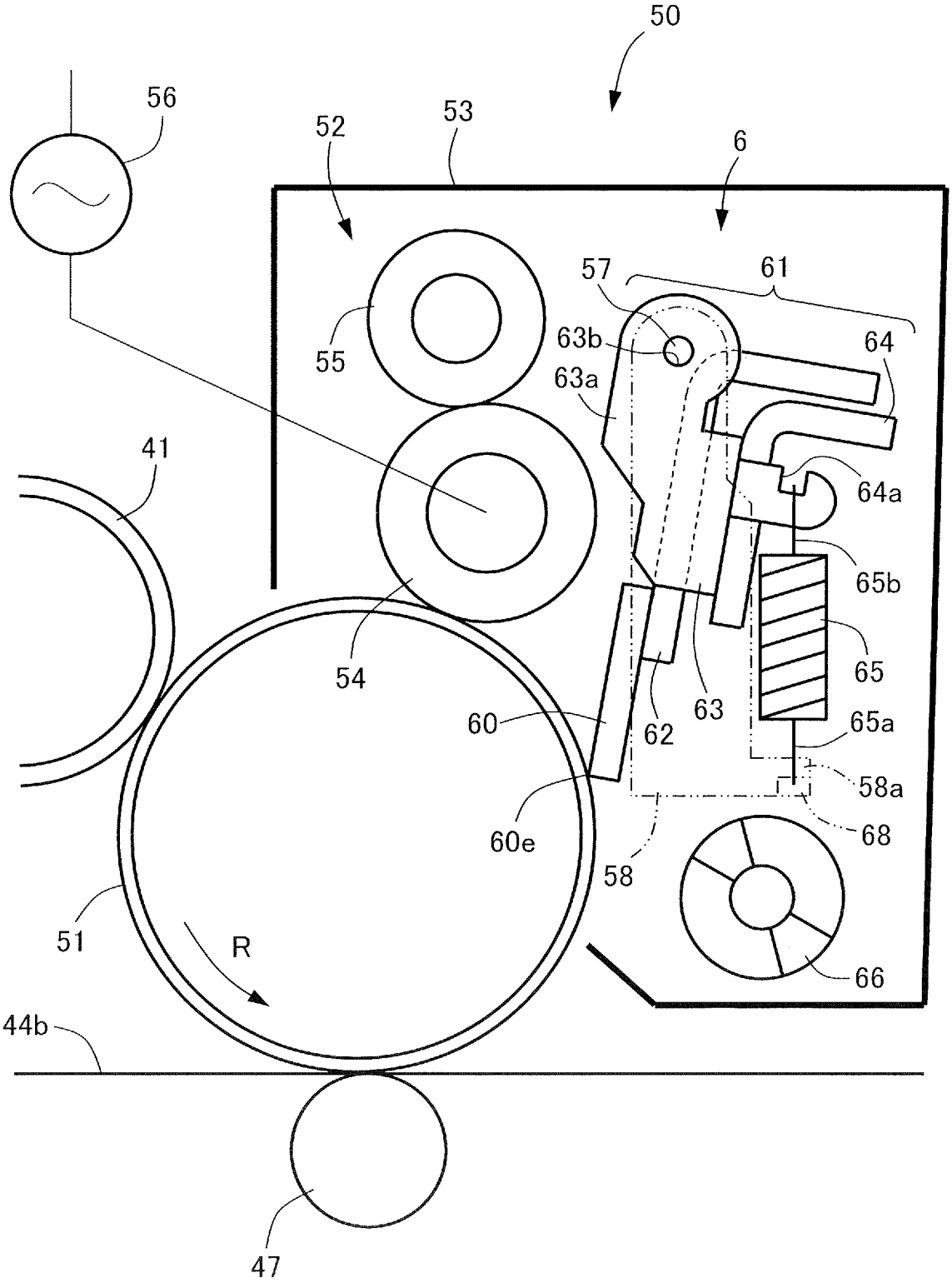
FIG. 2 is a section view illustrating a schematic configuration of a drum cartridge of the image forming apparatus of the first embodiment.

Each of the drum units 50*y*, 50*m*, 50*c* and 50*k* includes a photosensitive drum, serving as an image bearing member, 51 (51*y*, 51*m*, 51*c*, and 51*k*), moving while bearing a toner image, a charging unit 52 (52*y*, 52*m*, 52*c*, and 52*k*), a pre-exposing unit not illustrated, a cleaning unit 6 (6*y*, 6*m*, 6*c*, and 6*k*) and a case 53 storing these units (see FIG. 2). The drum unit 50 is unitized in a body as a process cartridge, is configured to be attachable/detachable to/from the apparatus body 2 and forms a toner image on an intermediate transfer belt 44*b* described later.

The photosensitive drum 51 is rotatably supported by the case 53 through a bearing not illustrated, bears an electrostatic image to be used for forming an image and bears a toner image after development of the electrostatic image. The photosensitive drum 51 is an organic photosensitive member (OPC) of negative charge in the present embodiment. The photosensitive drum 51 has 84 mm in outer diameter and 380 mm in length and is rotationally driven by a motor not illustrated in a direction of an arrow with 350 mm/s of process speed, i.e. rotation peripheral speed. The photosensitive drum 51 is formed of an aluminum cylinder as a base and includes three layers of an undercoating layer, a charge generating layer and a charge transport layer sequentially coated and laminated as a surface layer on a surface of the base. It is noted that an amorphous silicon drum or the like is applicable as the photosensitive drum 51.

As illustrated in FIG. 2, the charging unit 52 is retained by the case 53 holding the photosensitive drum 51 and homogeneously charges the surface of the photosensitive drum 51 before exposing the surface by the exposing unit 42. A scorotron charger having a grid electrode or roller charging using a charging roller is used as a charging unit in general, and the roller charging using the charging roller is applied as one example in the present embodiment. That is, the charging unit 52 includes a charging roller 54 and a roller cleaning member 55. The charging roller 54 is a rubber roller using a conductive rubber of 14 mm in outer diameter and 335 mm in length and rotates following the photosensitive drum 51. The charging roller 54 is connected with a charging bias power supply 56 provided in the apparatus body 2 (see FIG. 1). The charging bias power supply 56 applies AC of 1.7 kV to the charging roller 54 as a charging bias to charge the photosensitive drum 51. The roller cleaning member 55 is a sponge roller of 11.8 mm in outer diameter and 346 mm in length and rotates following the charging roller 54 to remove toner and external additives on the charging roller 54.

As illustrated in FIG. 1, the exposing unit 42 is a laser scanner and emits a laser beam in accordance to image information of separated colors outputted from the control portion 5. The electrostatic image formed by the exposing unit 42 is an aggregate of small dot images, and concentration of the toner image formed on the photosensitive drum 51 can be changed by changing density of the dot images.

The developing unit 40 stores developer supplied from the toner bottle not illustrated and develops the electrostatic image formed on the photosensitive drum 51 by the toner as the developing bias is applied. The developing unit 40 includes a developing sleeve 41 (41*y*, 41*m*, 41*c*, and 41*k*). The developing sleeve 41 is formed of a non-magnetic material such as aluminum and non-magnetic stainless steel for example. The developing sleeve 41 is made of aluminum in the present embodiment. Provided within the developing sleeve 41 is a magnet roller not illustrated and fixedly installed in non-rotational state with respect to the developing container. The developing sleeve 41 bears the developer containing the non-magnetic toner and magnetic carrier and conveys the developer to a developing area facing the photosensitive drum 51. The developing sleeve 41 is connected with a developing bias power supply not illustrated to apply DC voltage to the developing sleeve 41 as the developing bias to develop the electrostatic image formed on the photosensitive drum 51.

The toner image developed on the photosensitive drum 51 is primarily transferred onto the intermediate transfer unit 44. The surface of the photosensitive drum 51 after the primary transfer is destaticized by the pre-exposing unit not illustrated. After the primary transfer, the cleaning unit 6 scrapes and removes the toner left on the photosensitive drum 51 without being transferred onto the intermediate transfer unit 44. The scraped toner is collected by a collected toner conveyance unit not illustrated and is stored in a collecting toner box as removed toner. The cleaning unit 6 will be described in detail later.

The intermediate transfer unit 44 includes a plurality of rollers such as a driving roller 44*a*, a driven roller 44*d*, primary transfer rollers 47 (47*y*, 47*m*, 47*c*, and 47*k*) and the intermediate transfer belt 44*b* wrapped around these rollers and moves while bearing a toner image. The driven roller 44*d* is a tension roller controlling a tension of the intermediate transfer belt 44*b* to be constant. The primary transfer rollers 47*y*, 47*m*, 47*c* and 47*k* are disposed so as to face, respectively, the photosensitive drums 51*y*, 51*m*, 51*c* and 51*k* and are in contact with the intermediate transfer belt 44*b* to primarily transfer the toner image on the photosensitive drum 51 onto the intermediate transfer belt 44*b*.

The intermediate transfer belt 44*b* turns in a direction of an arrow with 150 mm/sec. The intermediate transfer belt 44*b* is in contact with the photosensitive drum 51 to form a primary transfer portion with the photosensitive drum 51. Then, as the primary transfer bias is applied to the intermediate transfer belt 44*b* from the primary transfer bias power supply not illustrated, the toner image formed on the photosensitive drum 51 is primarily transferred onto the intermediate transfer belt 44*b* at the primary transfer portion. That is, the respective negative polarity toner images on the photosensitive drums 51 are sequentially transferred and superimposed onto the intermediate transfer belt 44*b* by applying the positive polarity primary transfer bias to the intermediate transfer belt 44*b* by the primary transfer roller 47.

The intermediate transfer belt 44*b* is an endless belt having a three-layered structure of a resin layer, an elastic layer and a surface layer from a back surface side thereof. A material such as polyimide and polycarbonate can be used as a resin material constituting the resin layer of 70 to 100 μm in thickness. The toner left on the intermediate transfer belt 44*b* is cleaned by a transfer cleaning unit 48.

The secondary transfer portion 45 includes a secondary transfer inner roller 45*a* and a secondary transfer outer roller 45*b*. The secondary transfer inner roller 45*a* is disposed so as to face the secondary transfer outer roller 45*b* through the intermediate transfer belt 44*b*. The secondary transfer outer roller 45*b* is connected with a secondary transfer bias power supply not illustrated. With application of the secondary transfer bias having an inverse polarity from the toner, the secondary transfer outer roller 45*b* secondarily transfers the toner images borne on the intermediate transfer belt 44*b* collectively onto the sheet S supplied to a nip portion N between the secondary transfer outer roller 45*b* and the intermediate transfer belt 44*b*.

The fixing portion 46 includes a fixing roller 46*a* and a pressure roller 46*b*. As the sheet S is nipped and conveyed between the fixing roller 46*a* and the pressure roller 46*b*, the toner image which has been transferred onto the sheet S is heated and pressed and is fixed onto the sheet S.

The control portion 5 is composed of a computer and includes a CPU, a ROM storing programs controlling each portion, a RAM temporarily storing data and an input/output circuit inputting/outputting signals from/to external devices. The CPU is a microprocessor commanding overall control of the image forming apparatus 1 and is a main body of a system controller. The CPU is connected with the sheet feeding portion and the image forming portion 4 through the input/output circuit to exchange signals with the respective portions and to control their operations. An image forming control sequence or the like for forming an image on the sheet S is stored in the ROM. The charging bias power supply 56, the developing bias power supply, the primary transfer bias power supply and the secondary transfer bias power supply are connected with the control portion 5 to be controlled respectively by signals from the control portion 5.

Next, an image forming operation in the image forming apparatus 1 constructed as described above will be described. When the image forming operation is started, the photosensitive drum 51 rotates at first such that the surface thereof is charged by the charging unit 52. Then, the exposing unit 42 emits a laser beam to the photosensitive drum 51 based on image information to form an electrostatic image on the surface of the photosensitive drum 51. The electrostatic image is then developed by toner adhering on the electrostatic image and is visualized as a toner image. The toner image is then transferred onto the intermediate transfer belt 44*b*.

Meanwhile, the sheet S is supplied in parallel with such toner image forming operation. That is, the sheet S is conveyed to the secondary transfer portion 45 through a conveyance path by synchronizing with the toner image on the intermediate transfer belt 44*b*. The image is transferred from the intermediate transfer belt 44*b* onto the sheet S. Then, the sheet S is conveyed to the fixing portion 46 such that the non-fixed toner image is heated and pressed to be fixed on the surface of the sheet S. Then, the sheet S is discharged out of the apparatus body 2.

Next, a configuration of the cleaning unit 6 will be described in detail with reference to FIGS. 2 through 5. As illustrated in FIG. 2, the cleaning unit 6 is stored in the case 53 and is disposed downstream of the primary transfer roller 47 and the pre-exposing unit not illustrated and upstream of the charging unit 52 in terms of the rotation direction of the photosensitive drum 51. The cleaning unit 6 includes a cleaning blade 60, a swing portion 61 swingably supported by the case 53, a coil spring 65 and a collecting screw 66.

Figure 3:
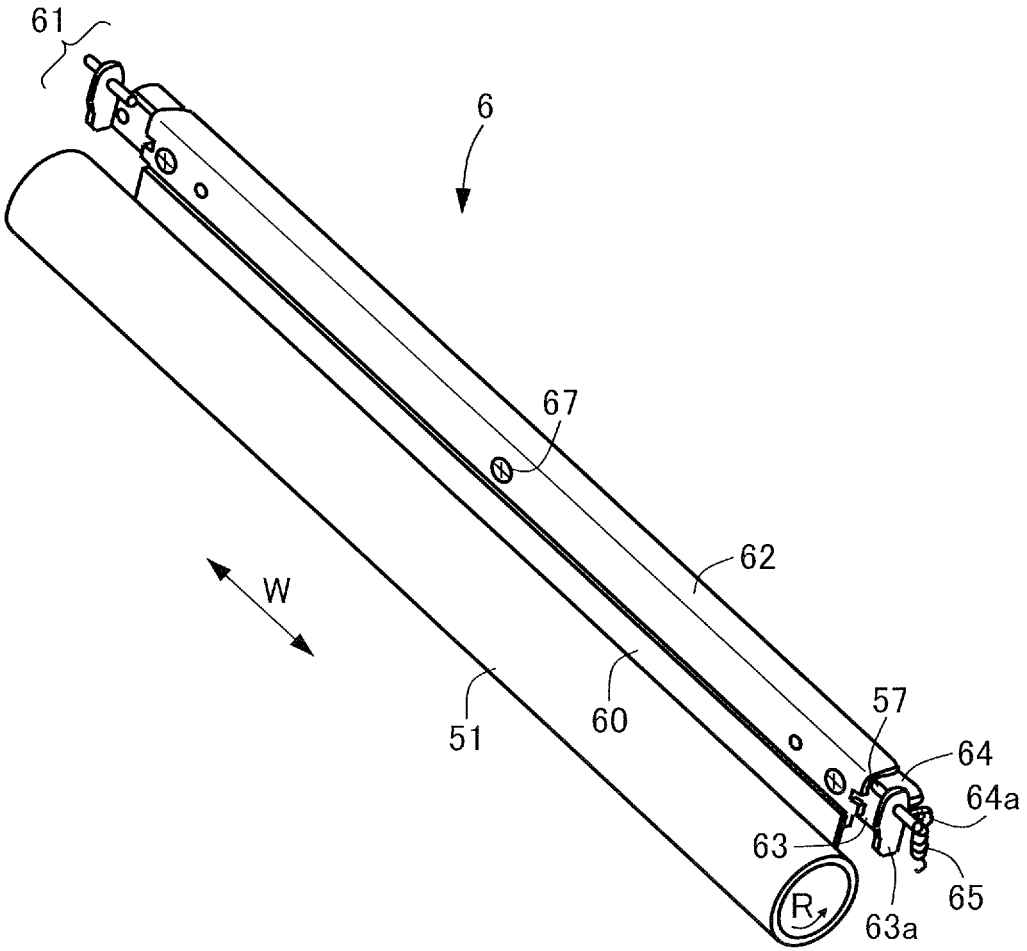
FIG. 3 is a perspective view illustrating a schematic configuration of the drum cartridge of the image forming apparatus of the first embodiment.
Figure 4:
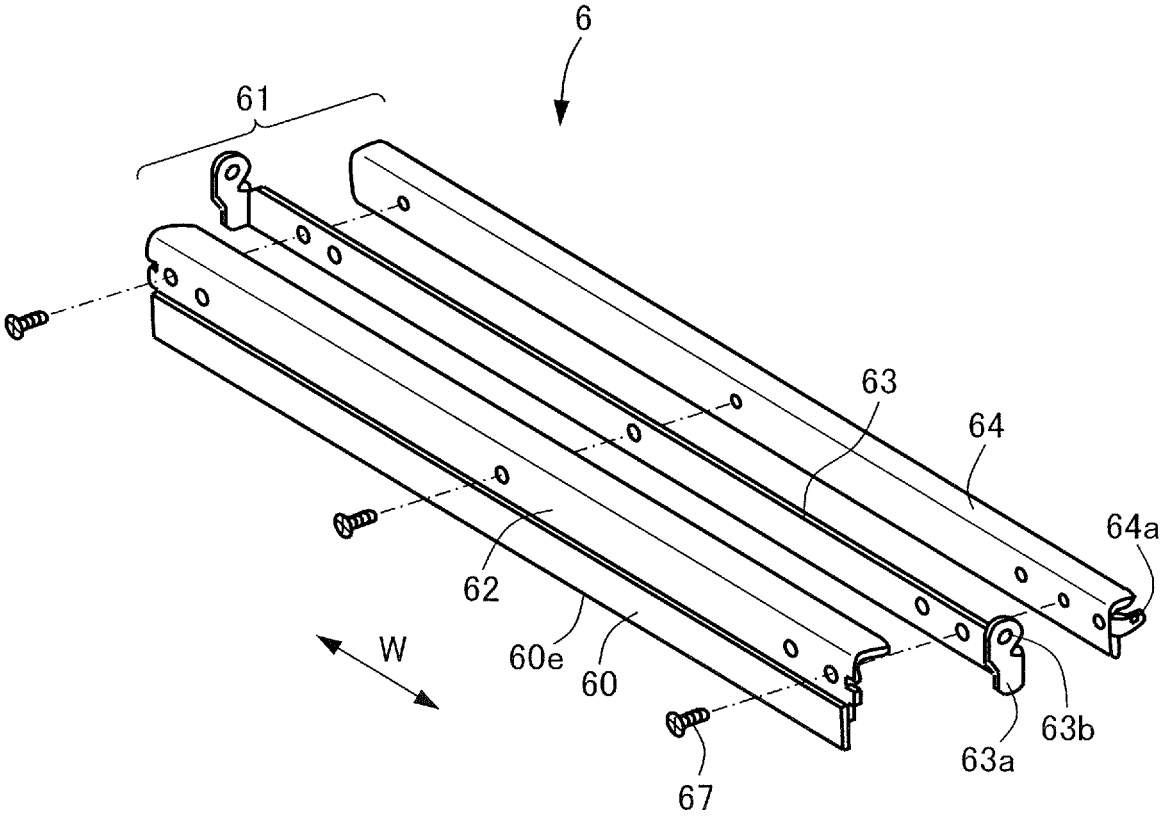
FIG. 4 is an exploded perspective view illustrating a schematic configuration of the drum cartridge of the image forming apparatus of the first embodiment.

As illustrated in FIGS. 2, 3 and 4, the cleaning blade, serving as a blade, 60 is a flat plate-like rubber blade such that a longitudinal direction of the cleaning blade 60 is along a direction of a rotation center line, i.e. a wide direction W, of the photosensitive drum 51 and is a urethane rubber blade of 2 mm in thickness, 12.5 mm in width and 350 mm in length for example. That is, the cleaning blade 60 is provided such that the longitudinal direction of the cleaning blade 60 is along the wide direction W orthogonal to a moving direction of the movable photosensitive drum 51. The cleaning blade 60 is of a counter blade type, and a front edge 60*e* thereof is in contact with the photosensitive drum 51 such that the front edge 60*e* counters in a rotation direction R of the photosensitive drum 51 with a predetermined pressing force, i.e. blade pressure. Thereby, the cleaning blade 60 scrapes and removes the transfer residual toner left on the photosensitive drum 51. The cleaning blade 60 comes into contact with the surface of the photosensitive drum 51 by being supported by the swing portion 61 to clean adhesive materials on the surface of the photosensitive drum 51. The pressing force of the cleaning blade 60 against the surface of the photosensitive drum 51 varies by swinging the swing portion 61 centering on a rotational axial line at a fixed position with respect to a fixed member 58 described later.

The swing portion, serving as a swing member, 61 includes a blade supporting plate 62, a swing plate 63 and a pressure plate 64 which are integrated by being fastened by a bolt 67. The blade supporting plate 62 is made of metal for example, is pasted with the cleaning blade 60 by adhesive for example and positions the cleaning blade 60 as the swing portion 61.

The swing plate 63 is a plate-like metallic plate member extending in the wide direction W of the photosensitive drum 51 and provided along the cleaning blade 60. The swing plate 63 includes a bent portion 63*a* having a shape bent on a side of the cleaning blade 60 and a swing center hole 63*b* defined in the bent portion 63*a* on each of longitudinal both end portions thereof. The swing center hole 63*b* is rotatably engaged with a support shaft 57 provided in the case 53, and the swing plate 63 is swingably supported by the case 53. In the present embodiment, the support shaft 57 is a shaft of 4 mm in diameter provided on the fixed member 58 fixed to the case 53 and extending in the wide direction W (see FIG. 6B). The configuration of the fixed member 58 will be described later.

The pressure plate 64 is a flat metallic plate member extending in the wide direction W of the photosensitive drum 51 and is provided along the cleaning blade 60. The pressure plate 64 includes a project portion 64*a* projecting on a side opposite to the cleaning blade 60 at each of longitudinal both ends. The project portion 64*a* projects like a hook facing upside and includes an engaging groove 64*b* dented downward (see FIG. 6B). A second end portion 65*b* of the coil spring 65 described later is engaged by the engaging groove 64*b*.

Figure 6A:
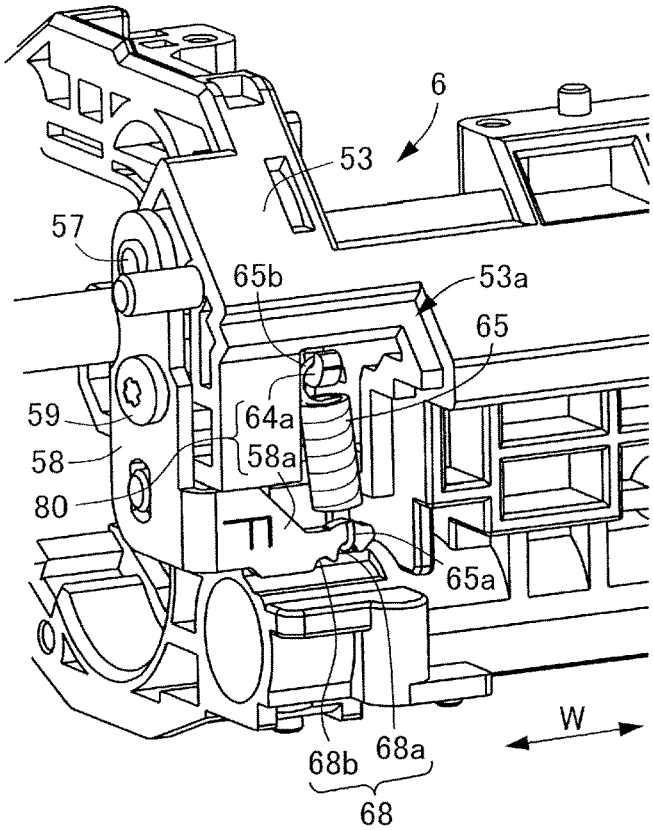
FIG. 6A is a perspective view illustrating a schematic configuration of a widthwise front side of the drum cartridge, in a case where a case is attached, of the image forming apparatus of the first embodiment.
Figure 6B:
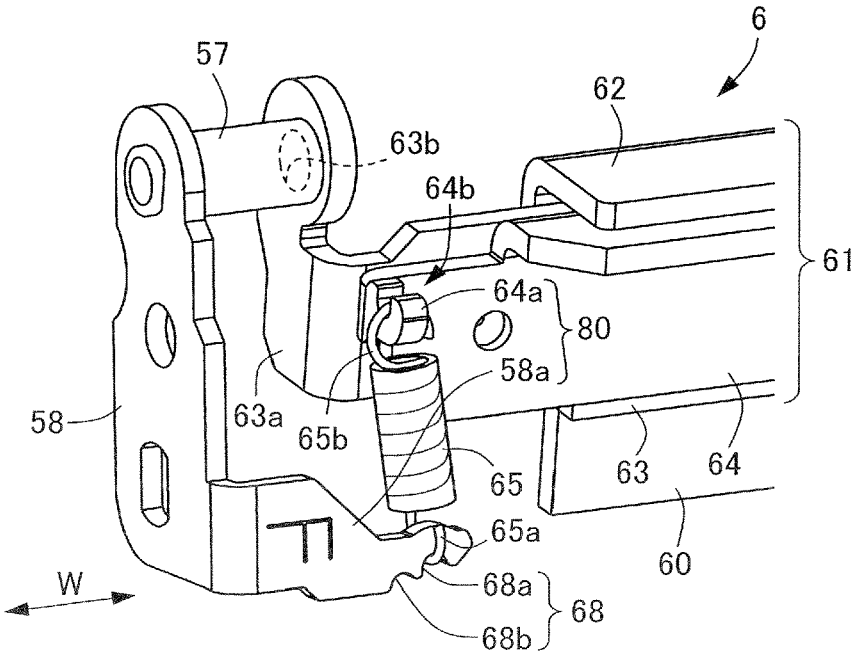
FIG. 6B is a perspective view illustrating a schematic configuration of the widthwise front side of the drum cartridge, in a case where the case is removed, of the image forming apparatus of the first embodiment.
Figure 7A:
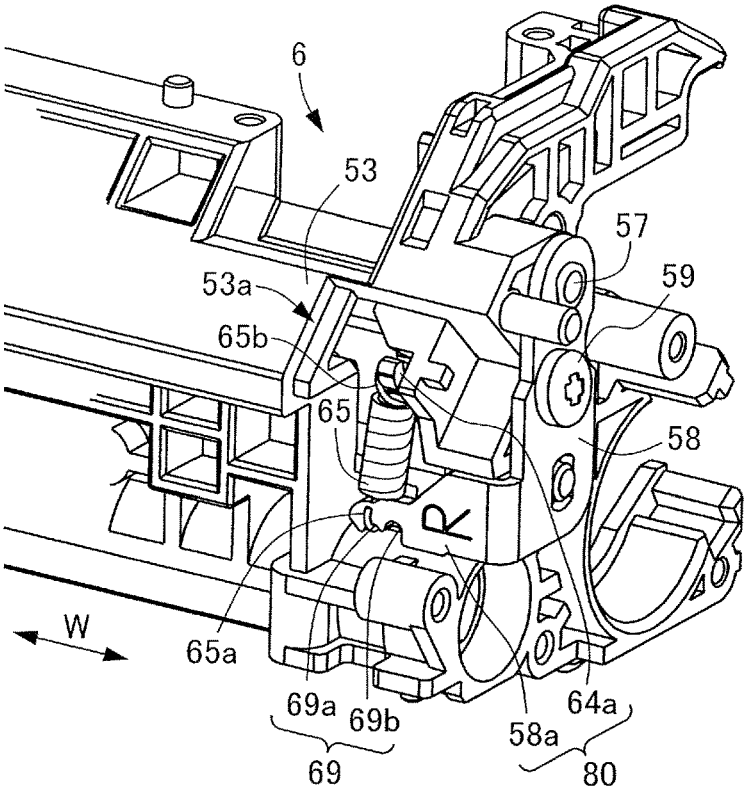
FIG. 7A is a perspective view illustrating a schematic configuration of a widthwise rear side of the drum cartridge, in a case where a case is attached, of the image forming apparatus of the first embodiment.
Figure 7B:
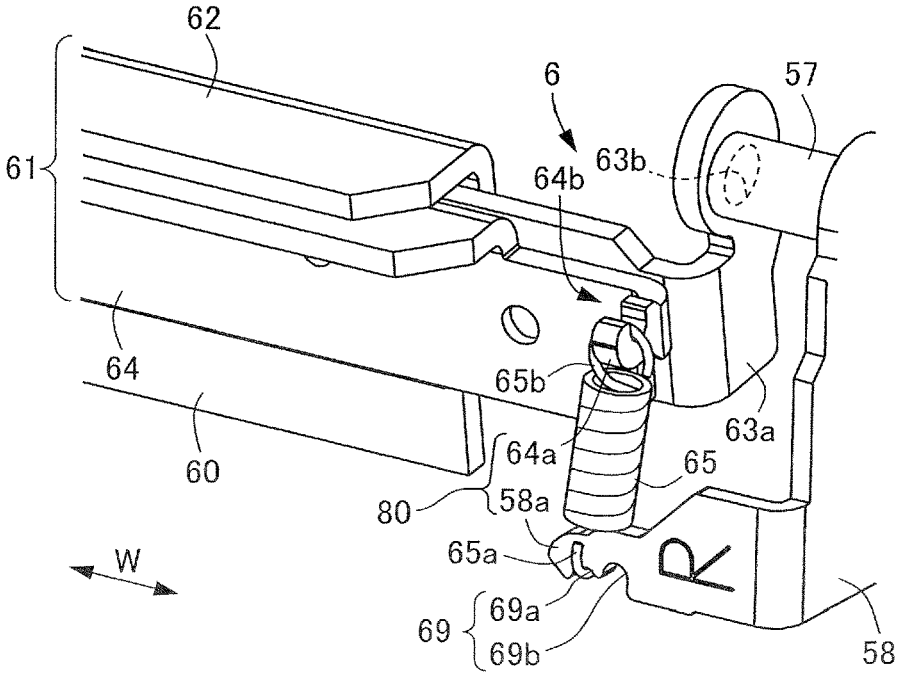
FIG. 7B is a perspective view illustrating a schematic configuration of the widthwise rear side of the drum cartridge, in a case where the case is removed, of the image forming apparatus of the first embodiment.

The coil spring 65 is a tension coil spring provided so as to link the fixed member 58 and the swing portion 61 and is disposed at each of front and rear ends of the cleaning blade 60. First end portion 65*a* of the coil spring 65 is linked with a bent portion 58*a* of the fixed member 58, and the second end portion 65*b* thereof is linked with the project portion 64*a* of the pressure plate 64 of the swing portion 61. Thereby, the coil spring 65 urges the swing portion 61 so as to rotate the swing portion 61 with respect to the fixed member 58 centering on the swing center hole 63*b* and presses the cleaning blade 60 against the surface of the photosensitive drum 51. As illustrated in FIGS. 7A and 7B, the coil spring 65 provided on a position of a first end side, i.e. rear side, of the cleaning blade 60 in the longitudinal direction is a first coil spring. Also, as illustrated in FIGS. 6A and 6B, the coil spring 65 provided on a position of a second end side, i.e. front side, of the cleaning blade 60 in the longitudinal direction is a second coil spring.

Figure 5:
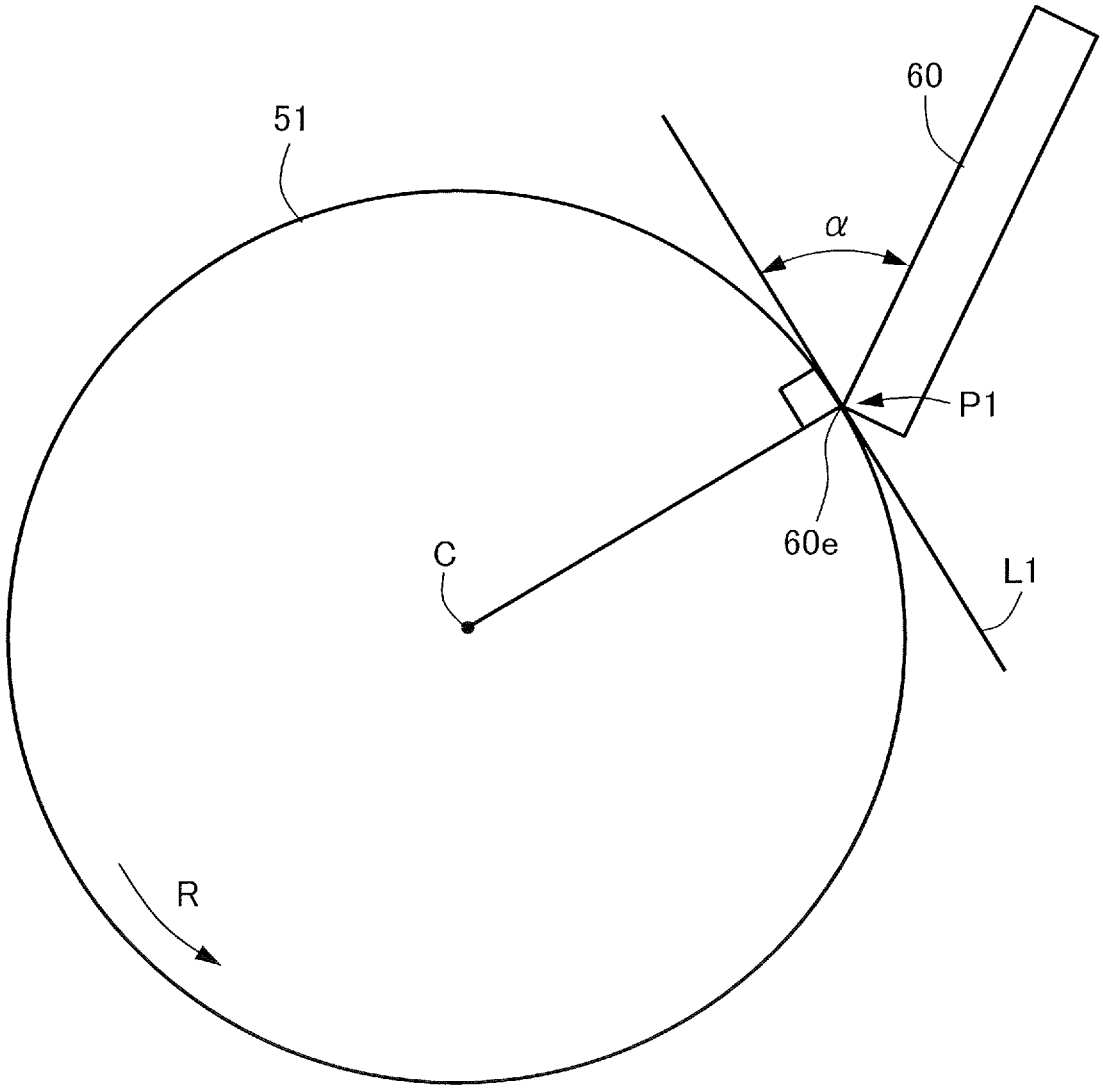
FIG. 5 is a side view illustrating a set angle between a photosensitive drum and a cleaning blade of the image forming apparatus of the first embodiment.

Here, as illustrated in FIG. 5, the cleaning blade 60 is in pressure contact with the photosensitive drum 51 while forming a predetermined angle, i.e. a set angle α. The cleaning blade 60 is an elastic member, and a contact point between the photosensitive drum 51 and the front edge 60*e* of the cleaning blade 60 in a undeformed state will be called as a contact point P1. An angle formed between a tangential line L1 of the photosensitive drum 51 and a side surface facing the photosensitive drum 51 of the cleaning blade 60 in contact in the undeformed state at the contact point P1 will be called as the set angle α.

If the set angle α is too small, a friction force between the cleaning blade 60 and the photosensitive drum 51 is reduced, possibly causing a cleaning failure without scraping all of the residual toner. Meanwhile, if the set angle α is too large, the friction force between the cleaning blade 60 and the photosensitive drum 51 increases, and the front edge 60*e* of the cleaning blade 60 in contact with the photosensitive drum 51 in counter becomes unable to keep the contact at the contact point P1. Thereby, the contact point P1 shifts in the rotation direction R of the photosensitive drum 51, and there is a possibility of causing a phenomenon of turning up of the blade by which the blade abuts with the photosensitive drum 51 while being directed in a normal direction opposite from the counter direction in the end. From these points, a suitable range of the set angle α is 10° to 40° and a more preferably 20° to 30°. In the present embodiment, the set angle α is set at 23.5°.

The urging force of the coil spring 65 is applied such that the front edge 60*e* of the cleaning blade 60 is in pressure contact with the photosensitive drum 51 through the swing portion 61. At this time, force acting toward a center line C of the photosensitive drum 51 from the cleaning blade 60 will be called as a blade pressure. If the blade pressure is too small, the friction force between the cleaning blade 60 and the photosensitive drum 51 is reduced, possibly causing the cleaning failure without scraping all of the residual toner. If the blade pressure is too large, the friction force between the cleaning blade 60 and the photosensitive drum 51 increases, possibly causing the turn-up of the blade. If the blade pressure is too large, abrasion of the surface of the photosensitive drum 51 is accelerated, possibly causing toner melt-sticking on the surface of the photosensitive drum 51 and image stripes or causing shortening of the life of the photosensitive drum 51. From these points, a preferable range of the blade pressure is 600 gf to 1200 gf which is set corresponding to a length, hardness and the like of the cleaning blade 60. In the present embodiment, the blade pressure is set at 900 gf.

As described above, it is important to favorably clean the residual toner and to prolong the life of the photosensitive drum 51 to set the blade pressure and the set angle α of the cleaning blade 60 in the suitable ranges. However, due to component tolerance and so on, there is a possibility of causing a divergence of generating line between the line connecting the swing center holes 63*b* and the center line C of the photosensitive drum 51. Still further, because the generating line fluctuates due to tolerance of the position of the support shaft 57, to tolerance of the load of the coil spring 65, to tolerance of the hardness and shape of the cleaning blade 60 and to deviation of outer shape of the photosensitive drum 51, it is difficult to set them in the preferable ranges. In order to solve this problem, although it is conceivable to provide a pressing force switching unit capable of switching the pressing force of the cleaning blade 60, the pressing force switching unit is enlarged if the resolution of adjustment of the pressing force is to be enhanced by one pressing force switching unit.

Figure 8:
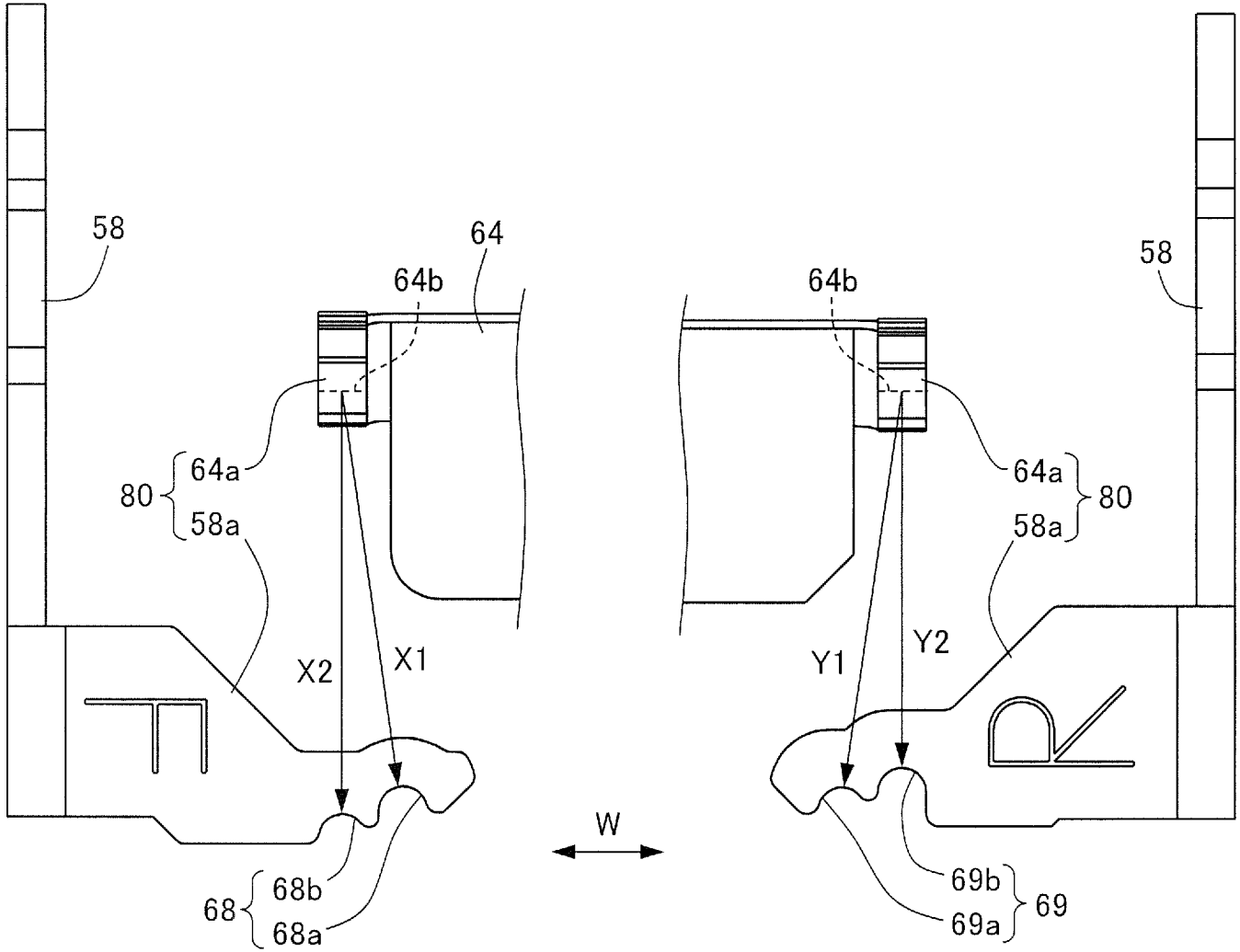
FIG. 8 is a front view illustrating each load adjusting unit in the drum cartridge of the image forming apparatus of the first embodiment.

Then, as illustrated in FIGS. 6A through 8, the cleaning unit 6 of the present embodiment enables to adjust the pressing force by a front load adjusting unit 68 and a rear load adjusting unit 69 for each of the coil springs 65 provided on both widthwise ends. That is, as illustrated in FIGS. 6A, 6B and 8, the pressing force of the coil spring 65 provided on the front side in the wide direction W can be adjusted by the front load adjusting unit 68. Still further, as illustrated in FIGS. 7A, 7B and 8, the pressing force of the coil spring 65 provided on the rear side in the wide direction W can be adjusted by the rear load adjusting unit 69. The front load adjusting unit 68 and the rear load adjusting unit 69 can adjust the pressing force of the coil spring 65 pressing the cleaning blade 60 against the surface of the photosensitive drum 51 by adjusting the urging force of at least a part of the coil springs 65.

A characteristic configuration of the cleaning unit 6 of the present embodiment will be described below. It is noted that while the configurations of the front load adjusting unit 68 and the rear load adjusting unit 69 are different in the present embodiment, configurations other than that such as the fixed members 58 are approximately symmetrical on the both sides in the wide direction W. Therefore, they will be denoted by the same reference numeral and their detailed description will be omitted here.

As illustrated in FIGS. 6A and 6B, the fixed member 58 includes the bent portion, serving as an arm portion, 58*a* bent inward in the wide direction W at the widthwise front side and is fastened to the case 53 by a bolt 59. That is, the case 53 includes the bent portion 58*a* and the bent portion 58*a* is extended in the longitudinal direction of the cleaning blade 60 at the first end side of the cleaning blade 60 in the longitudinal direction. The bent portion 58*a* disposed on the fixed member 58 and the project portion 64*a* disposed on the swing portion 61 facing the bent portion 58*a* compose a link portion 80. As described later, the link portion 80 is disposed at each end in the wide direction W of the cleaning blade 60.

The front load adjusting unit 68 is formed at a lower edge part of the bent portion 58*a*. The front load adjusting unit 68 includes a plurality of engaging grooves, serving as a plurality of second engaging portions, 68*a* and 68*b* to which one coil spring 65 can be selectively linked or engageable. Here, the front load adjusting unit 68 includes the first engaging groove 68*a* disposed at a widthwise center side and the second engaging groove 68*b* disposed at a widthwise outer side adjacent the first engaging groove 68*a*. That is, the first engaging groove 68*a* is disposed closer to the first end side of the cleaning blade 60 than the second engaging groove 68*b* is, in terms of the longitudinal direction of the cleaning blade 60. That is, in the link portion 80 at the widthwise front end part, the engaging grooves 64*b*, 68*a* and 68*b* capable of engaging the respective end portions 65*a* and 65*b* of the coil spring 65 are provided respectively in the bent portion 58*a* and the project portion 64*a*. Still further, in the link portion 80 at the widthwise front end, two of engaging grooves 64*b*, 68*a* and 68*b* are provided at least one of the bent portion 58*a* and the project portion 64*a*. The respective engaging grooves 68*a* and 68*b* are located approximately right under the engaging groove 64*b* of the pressure plate 64. The engaging grooves 68*a* and 68*b*, the engaging groove 64*b* and the coil spring 65 stretched between them are exposed out of an opening portion 53*a* of the case 53. That is, the plurality of second engaging portions are provided at a location exposed out of the case 53. Therefore, the project portion 64*a* is provided on the swing portion 61 such that the project portion 64*a* is exposed out of the case 53 and engages the second end portion 65*b* of the coil spring 65.

The first engaging groove 68*a* and the second engaging groove 68*b* are formed stepwise such that an operation length of the coil spring 65 can be changed. Here, as illustrated in FIG. 8, a distance between the first engaging groove 68*a* and the engaging groove 64*b* is set as X1, and a distance between the second engaging groove 68*b* and the engaging groove 64*b* is set as X2. Here, the distances are set as X2>X1. An operator can change the blade pressure stepwise by changing the engaging position of the first end portion 65*a* of the coil spring 65 between the first engaging groove 68*a* and the second engaging groove 68*b* by a tool or the like. The pressing force in pressing the cleaning blade 60 against the surface of the photosensitive drum 51 can be changed by changing the length of the coil spring 65. That is, the engaging grooves 68*a* and 68*b* are disposed such that the pressing force in pressing the cleaning blade 60 against the surface of the photosensitive drum 51 is differentiated by differentiating the relative position of the first end portion 65*a* and the second end portion 65*b* per engaging grooves 68*a* and 68*b* to which the coil spring 65 is linked. The plurality of second engaging portions are provided on one of the case 53 or the swing portion 61 and are configured to selectively engage the first end portion, serving as one end side, 65*a* of the second coil spring 65 at different positions with respect to the longitudinal direction of the cleaning blade 60. The plurality of second engaging portions can change a contact pressure of the cleaning blade 60 against the photosensitive drum 51 caused by the second coil spring by changing the engaging position of the second coil spring. The plurality of second engaging portions are two second engaging portions which are the first engaging groove, serving as one second engaging portion, 68*a* located at a third position and the second engaging groove, serving as another second engaging portion, 68*b* located at a fourth position which is different position from the third position with respect to the longitudinal direction of the cleaning blade 60. It is noted that because the respective engaging grooves 68*a* and 68*b* are both located approximately right under the engaging groove 64*b*, an angular change in the width direction caused by switching of the coil spring 65 is fully small and a tensile force of the coil spring 65 is almost coincident with a component of force in the rotation direction of the pressure plate 64. Although the engaging grooves of the front load adjusting unit 68 are provided at the two places of the engaging grooves 68*a* and 68*b* in the present embodiment, the present disclosure is not limited to them and may be provided with three or more places.

As illustrated in FIGS. 7A and 7B, the fixed member 58 includes the bent portion, serving as an arm portion, 58*a* bent inward in the wide direction W at the widthwise rear side and is fastened to the case 53 by a bolt 59. That is, the case 53 includes the bent portion 58*a* and the bent portion 58*a* is extended in the longitudinal direction of the cleaning blade 60 at the first end side of the cleaning blade 60 in the longitudinal direction. The bent portion 58*a* disposed on the fixed member 58 and the project portion 64*a* disposed on the swing portion 61 facing the bent portion 58*a* compose a link portion 80. That is, the link portion 80 is disposed at each front and rear ends in the wide direction W of the cleaning blade 60.

The rear load adjusting unit 69 is formed at a lower edge part of the bent portion 58*a*. The rear load adjusting unit 69 includes a plurality of engaging grooves, serving as a plurality of first engaging portions, 69*a* and 69*b* to which one coil spring 65 can be selectively linked or engageable. Here, the rear load adjusting unit 69 includes the first engaging groove 69*a* disposed at a widthwise center side and the second engaging groove 69*b* disposed at a widthwise outer side adjacent the first engaging groove 69*a*. That is, the first engaging groove 69*a* is disposed closer to the second end side of the cleaning blade 60 than the second engaging groove 69*b* is, in terms of the longitudinal direction of the cleaning blade 60. That is, in the link portion 80 at the widthwise rear end side, the engaging grooves 64*b*, 69*a* and 69*b* capable of engaging the respective end portions 65*a* and 65*b* of the coil spring 65 are provided respectively in the bent portion 58*a* and the project portion 64*a*. Still further, in the link portion 80 at the widthwise rear end side, two of engaging grooves 64*b*, 69*a* and 69*b* are provided at least one of the bent portion 58*a* and the project portion 64*a*. The respective engaging grooves 69*a* and 69*b* are located approximately right under the engaging groove 64*b* of the pressure plate 64. The engaging grooves 69*a* and 69*b*, the engaging groove 64*b* and the coil spring 65 stretched between them are exposed out of the opening portion 53*a* of the case 53. That is, the plurality of first engaging portions are provided at a location exposed out of the case 53. Also, the project portion 64*a* is provided on the swing portion 61 such that the project portion 64*a* is exposed out of the case 53 and engages the second end portion 65*b* of the coil spring 65. That is, the second end portion 65*b* of the first coil spring is engaged by another one of the case 53 or the swing portion 61.

The first engaging groove 69*a* and the second engaging groove 69*b* are formed stepwise such that an operation length of the coil spring 65 can be changed. Here, as illustrated in FIG. 8, a distance between the first engaging groove 69*a* and the engaging groove 64*b* is set as Y1, and a distance between the second engaging groove 69*b* and the engaging groove 64*b* is set as Y2. Here, the distances are set as Y1>Y2. The operator can change the blade pressure stepwise by changing the engaging position of the first end portion 65*a* of the coil spring 65 between the first engaging groove 69*a* and the second engaging groove 69*b* by a tool or the like. The pressing force in pressing the cleaning blade 60 against the surface of the photosensitive drum 51 can be changed by changing the length of the coil spring 65. That is, the engaging grooves 69*a* and 69*b* are disposed such that the pressing force in pressing the cleaning blade 60 against the surface of the photosensitive drum 51 is differentiated by differentiating the relative position of the first end portion 65*a* and the second end portion 65*b* per engaging grooves 69*a* and 69*b* to which the coil spring 65 is linked. The plurality of first engaging portions are provided on one of the case 53 or the swing portion 61 and are configured to selectively engage the first end portion, serving as one end side, 65*a* of the first coil spring 65 at different positions with respect to the longitudinal direction of the cleaning blade 60. The plurality of first engaging portions can change a contact pressure of the cleaning blade 60 against the photosensitive drum 51 caused by the first coil spring by changing the engaging position of the first coil spring. The plurality of first engaging portions are two first engaging portions which are the first engaging groove, serving as one first engaging portion, 69*a* located at a first position and the second engaging groove, serving as another first engaging portion, 69*b* located at a second position which is a different position from the first position with respect to the longitudinal direction of the cleaning blade 60. It is noted that because the respective engaging grooves 69*a* and 69*b* are both located approximately right under the engaging groove 64*b*, an angular change in the width direction caused by switching of the coil spring 65 is fully small and a tensile force of the coil spring 65 is almost coincident with a component of force in the rotation direction of the pressure plate 64. Although the engaging grooves of the rear load adjusting unit 69 are provided at the two places of the engaging grooves 69*a* and 69*b* in the present embodiment, the present disclosure is not limited to them and may be provided with three or more places.

As for the engaging grooves 68*a* and 68*b* of the front load adjusting unit 68 and the engaging grooves 69*a* and 69*b* of the rear load adjusting unit 69, a relationship with the distances, i.e. operation lengths, to the engaging groove 64*b* is set such that X2>X1=Y1>Y2. Due to that, a range in which the pressing force varies is differentiated in a case where the engaging grooves 68*a* and 68*b* and the engaging grooves 69*a* and 69*b* to which the coil spring 65 is engaged are changed between the front and rear load adjusting units 68 and 69. Still further, according to the present embodiment, X2−X1=1.3 mm and a difference of loads is set at 20 gf for example in the front load adjusting unit 68, and Y1−Y2=0.8 mm and a difference of loads is set at 20 gf for example in the rear load adjusting unit 69. The blade pressure can be kept in the preferable range by thus setting the adjustment range around ±20 gf. In this case, a reason why the operation lengths are different even through the difference of loads is the same among the front load adjusting unit 68 and the rear load adjusting unit 69 is because the cleaning blade 60 deflects largely when the load is increased and the operation length needs to be increased accordingly. A contact pressure of the cleaning blade 60 against the photosensitive drum 51 caused by the first coil spring when the first end portion 65*a* of the coil spring 65 is engaged by the first engaging groove 69*a* at the first position is a first contact pressure. A contact pressure of the cleaning blade 60 against the photosensitive drum 51 caused by the first coil spring when the first end portion 65*a* of the coil spring 65 is engaged by the second engaging groove 69*b* at the second position is a second contact pressure which is lower than the first contact pressure. A contact pressure of the cleaning blade 60 against the photosensitive drum 51 caused by the second coil spring when the first end portion 65*a* of the coil spring 65 is engaged by the first engaging groove 68*a* at the third position is substantially equal to the first contact pressure as described later. A contact pressure of the cleaning blade 60 against the photosensitive drum 51 caused by the second coil spring when the first end portion 65*a* of the coil spring 65 is engaged by the second engaging groove 68*b* at the fourth position is a third contact pressure which is higher than the first contact pressure.

Thus, according to the present embodiment, the pressing force can be changed at least to three different steps by changing combinations of the engaging grooves 68*a* and 68*b* and the engaging grooves 69*a* and 69*b* to which the coil spring 65 is engaged selected at the link portion 80 at each widthwise end portion. The engaging groove 64*b*, the engaging grooves 68*a* and 68*b* and the engaging grooves 69*a* and 69*b* of the link portion 80 at the widthwise end portion are disposed to that end.

Still further, although the engaging grooves 68*a* and 68*b* of the front load adjusting unit 68 and the engaging grooves 69*a* and 69*b* of the rear load adjusting unit 69 are both provided stepwise approximately right under the engaging groove 64*b* of the pressure plate 64 in the present embodiment, the present disclosure is not limited to such configuration. For instance, the first engaging groove 68*a* of the front load adjusting unit 68 may be disposed right under the engaging groove 64*b*, and the second engaging groove 68*b* may be disposed at a position deviated from the position right under the engaging groove 64*b*. In this case, because the second engaging groove 68*b* and the engaging groove 64*b* are not disposed along the rotation direction of the pressure plate 64, the tensile force of the pressure plate 64 does not coincide with the component of force in the rotation direction of the pressure plate 64. Due to that, instead of the operation length of the coil spring 65, it is necessary to set the adjustment force of the blade pressure by taking the component of force in the rotation direction of the pressure plate 64 caused by the coil spring 65 into consideration. Still further, in this case, the adjustment force of the blade pressure may be set by changing the component of force in the rotation direction of the pressure plate 64 by changing the direction of the coil spring 65 without changing the operation length of the coil spring 65.

Next, a procedure in adjusting the blade pressure of the cleaning blade 60 of the present embodiment will be described. The coil spring 65 is stretched between the first engaging groove 68*a* of the front load adjusting unit 68 and the engaging groove 64*b* of the pressure plate 64 and the coil spring 65 is stretched between the first engaging groove 69*a* of the rear load adjusting unit 69 and the engaging groove 64*b* of the pressure plate 64 in assembling the drum unit 50. At this time, because the operation length X1 of the front coil spring 65 is set to be equal to the operation length Y1 of the rear coil spring 65, they contribute the blade pressure of 450 gf, respectively, with respect to the set blade pressure of 900 gf in the present embodiment. While the blade pressure of the front coil spring 65 is set equally with that of the rear coil spring 65 in the present embodiment, they may be different if they are considered to be substantially equal. For instance, if the blade pressure of the rear coil spring 65 is within 20% with respect to the blade pressure of the front coil spring 65, they can be considered to be equal. In a case where the blade pressure has become out of the preferable blade pressure range due to the component tolerance or the like by measuring the blade pressure after assembling the drum unit 50, the blade pressure can be adjusted by changing the engaging grooves 68*a* and 68*b* and the engaging grooves 69*a* and 69*b* to which the coil spring 65 is engaged.

For instance, in a case where the blade pressure is smaller than the preferable range, it is possible to increase the blade pressure by switching the front coil spring 65 from the first engaging groove 68*a* to the second engaging groove 68*b* of the front load adjusting unit 68. According to the present embodiment, it is possible to increase the blade pressure by 100 gf for example by switching from the first engaging groove 68*a* to the second engaging groove 68*b*. In a case where the blade pressure is larger than the preferable range, it is possible to decrease the blade pressure by switching the rear coil spring 65 from the first engaging groove 69*a* to the second engaging groove 69*b* of the rear load adjusting unit 69. According to the present embodiment, it is possible to decrease the blade pressure by 100 gf for example by switching from the first engaging groove 69*a* to the second engaging groove 69*b*.

As described above, according to the drum unit 50 of the present embodiment, because the coil springs 65 are provided at the respective widthwise ends of the cleaning blade 60, it is possible to prevent the drum unit 50 from increasing in size by suppressing the load adjusting unit of each coil spring 65 from increasing in size. That is, the load adjusting unit increases in size by enhancing the resolution of adjusting the pressing force. The increase in size is large in one place in a case where the coil spring 65 is provided at one place. However, it is possible to disperse the increase in size in a case where the coil springs 65 are provided at the plural places. Due to that, if the same resolution is to be obtained, it is possible to downsize as a whole by providing the load adjusting units at plural places rather than providing the load adjusting unit at one place. Therefore, according to the drum unit 50 of the present embodiment, it is possible to improve the resolution of adjusting the pressing force of the cleaning blade 60 against the photosensitive drum 51 while suppressing the increase in size. Still further, because the coil springs 65 are provided at the plural places, it is possible to adjust to the preferable blade pressure more accurately because it becomes possible to set the resolution of the adjustment more finely as compared to the case where the load adjusting unit is provided at one place.

According to the drum unit 50 of the present embodiment, the coil springs 65 are disposed at the front and rear end portions of the cleaning blade 60. Due to that, because this arrangement makes it possible to adjust the blade pressure in a well-balanced manner along the wide direction W and to dispose the coil springs 65 within a limited space of the opening portion 53*a* of the case 53, it is possible to downsize the drum unit 50. It is also possible to effectively suppress the increase in size because the front and rear load adjusting units 68 and 69 can be readily disposed.

Still further, according to the drum unit 50 of the present embodiment, it is possible to improve the operability because the blade pressure adjusting operation is a simple operation of switching the coil springs 65.

It is noted that while the case where the front load adjusting unit 68 and the rear load adjusting unit 69 in the drum unit 50 of the present embodiment described above include the two engaging grooves, respectively, has been described, the present disclosure is not limited to such configuration. For instance, the front load adjusting unit 68 and the rear load adjusting unit 69 may have three or more engaging grooves, respectively. This arrangement makes it possible to change the pressing force of the cleaning blade 60 caused by the coil spring 65 to different three steps or more depending on a combination of the engaging grooves of the link portions 80 selected at each end.

While the case where the plurality of engaging grooves 68*a*, 68*b*, 69*a* and 69*b* are provided on the fixed member 58, i.e. the fixing portion, has been described in the drum unit 50 of the present embodiment, the present disclosure is not limited to such configuration. For instance, it is possible to arrange such that the plurality of engaging grooves are provided on the pressure plate 64 or the like of the swing portion 61 and one engaging groove is provided on the fixed member 58. In this case, the coil spring 65 is provided such that it is engaged only by one place of the fixed member 58 and is switched to the plurality of link portions on the swing portion 61 side. Or, the plurality of engaging grooves may be provided on both of the fixed member 58 and the swing portion 61.

EXAMPLE

Figure 9:
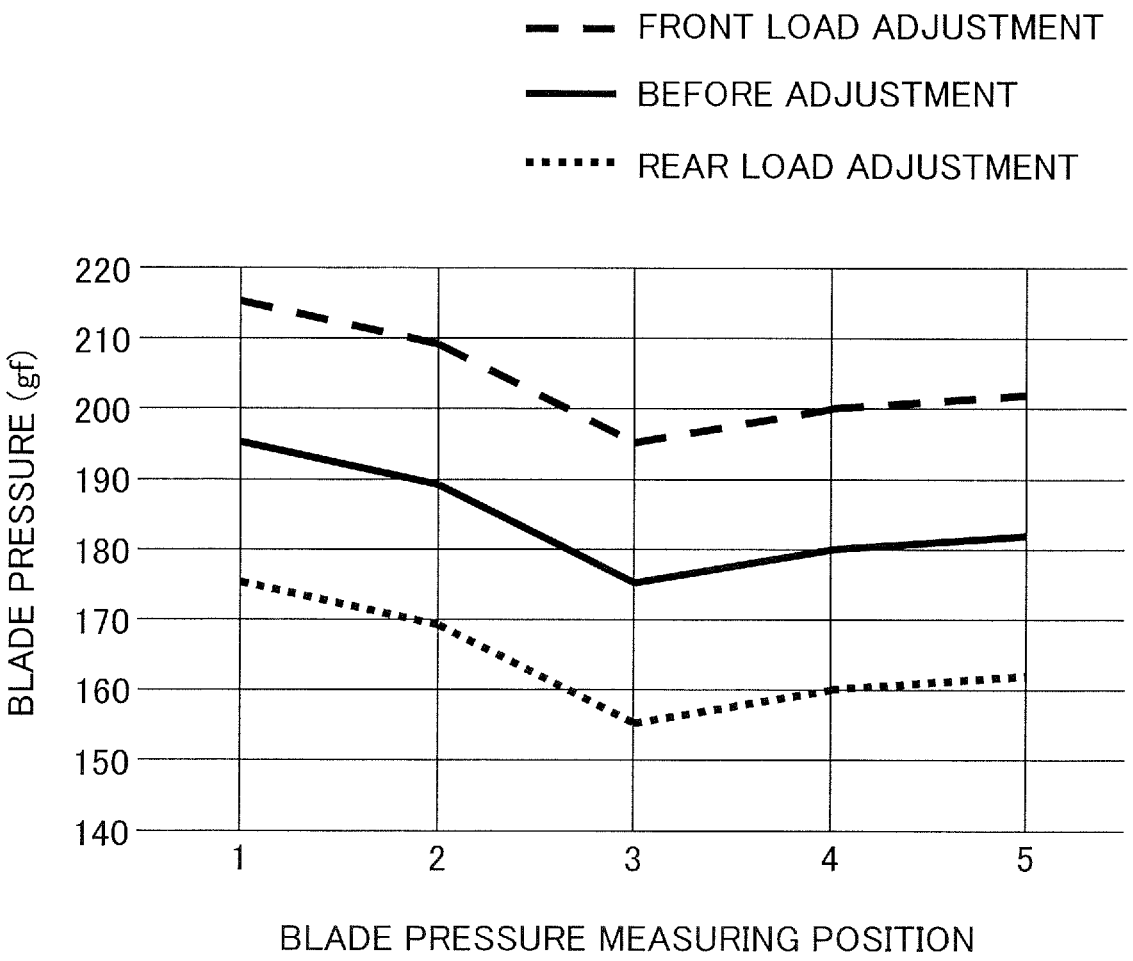
FIG. 9 is a graph indicating a relationship between blade pressure measuring positions and blade pressures in the drum cartridge of the image forming apparatus of the first embodiment.

Fluctuations of the blade pressures in switching the front and rear coil springs 65 were measured by using the image forming apparatus 1 of the present embodiment. The measurement was executed by using load cells disposed at five equidistant measuring positions in the wide direction W of the cleaning blade 60. A set blade pressure of each measuring position was 900 gf/5=180 gf. FIG. 9 indicates results of the measurement. As illustrated in FIG. 9, before the adjustment, the coil spring 65 is stretched between the first engaging groove 68*a* of the front load adjusting unit 68 and the engaging groove 64*b* of the pressure plate 64 and the coil spring 65 is stretched between the first engaging groove 69*a* of the rear load adjusting unit 69 and the engaging groove 64*b* of the pressure plate 64. In contrast to that, FIG. 9 illustrates a case where the coil spring 65 is switched and stretched from the first engaging groove 68*a* to the second engaging groove 68*b* of the front load adjusting unit 68 and a case where the coil spring 65 is switched and stretched from the first engaging groove 69*a* to the second engaging groove 69*b* of the rear load adjusting unit 69.

As illustrated in FIG. 9, the front load adjusting unit 68 and the rear load adjusting unit 69 are provided at both ends of front and rear in the wide direction W of the cleaning blade 60 in the present embodiment, operation loads of the front and rear coil springs 65 change by implementing the adjustment. In contrast, because the blade supporting plate 62, the swing plate 63 and the pressure plate 64 composing the cleaning unit 6 are fully stiff, it was confirmed that no inclination of load in the front and rear sides occurs and the blade pressure can be adjusted uniformly. It was also confirmed that the amounts of adjustment of the blade pressure can be accurately adjusted, respectively. It is noted that in the present embodiment, a load changed by switching from the first engaging groove 68*a* to the second engaging groove 68*b* of the front load adjusting unit 68 is set to be greater than a load changed by switching from the first engaging groove 69*a* to the second engaging groove 69*b* of the rear load adjusting unit 69. That is, the operation lengths of the coil springs 65 are set as X2−X1>Y1−Y2. It is because the blade pressure is obtained by pressing the photosensitive drum 51 through the cleaning blade 60 which is the elastic member, and a relationship between the load and deflection of the elastic member is not linear.

Second Embodiment

Figure 10A:
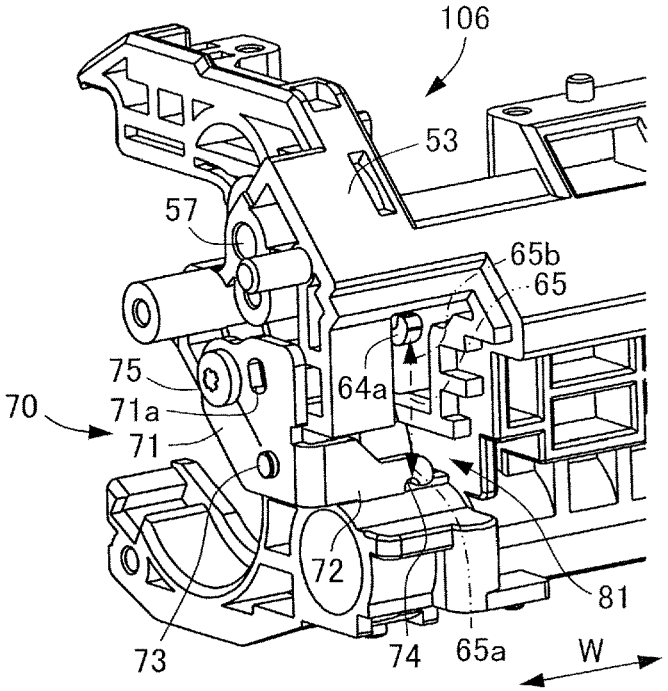
FIG. 10A is a perspective view illustrating a schematic configuration of a widthwise front side of a drum cartridge, in a case where a case is attached, of an image forming apparatus of a second embodiment.
Figure 10B:
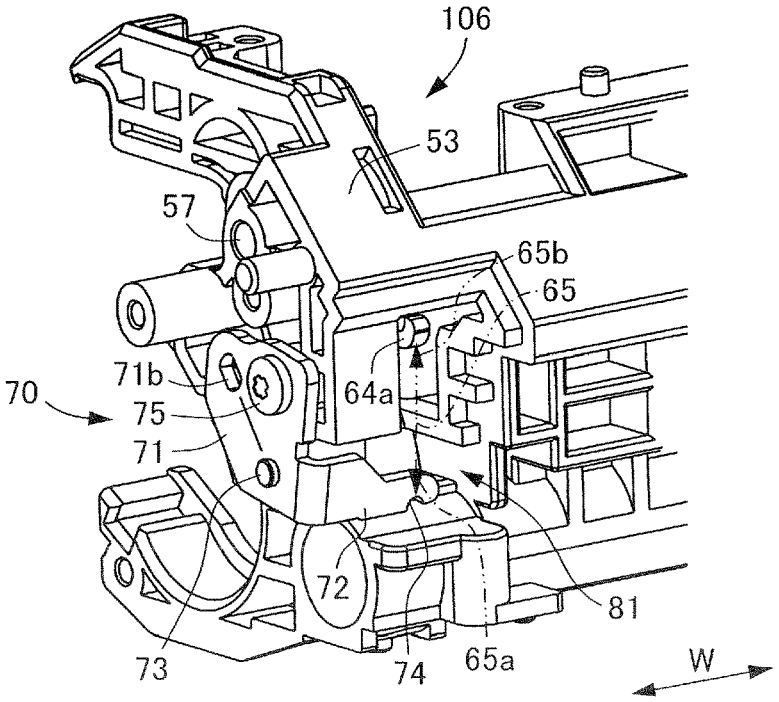
FIG. 10B is a perspective view illustrating a schematic configuration of the widthwise front side of the drum cartridge, in a case where the case is removed, of the image forming apparatus of the second embodiment.

A second embodiment of the present disclosure will be described in detail with reference to FIGS. 10A and 10B. While the fixed member 58 is immovably fixed to the case 53 in the first embodiment, the present embodiment is different from the configuration of the first embodiment in that a movable member 71 is movably provided with respect to the case 53. Still further, while the front and rear load adjusting units 68 and 69 have the engaging grooves in the first embodiment, a load adjusting unit 70 of the present embodiment is different from the configuration of the first embodiment in that the load adjusting unit 70 includes the movable member 71 and a fixing bolt 75. Because the configurations other than those described above are the same with the configurations of the first embodiment, they will be denoted by the same reference numerals and their detailed description will be omitted.

According to the present embodiment, a cleaning unit 106 includes the case 53, the cleaning blade 60, the swing portion 61 (see FIG. 2), the load adjusting unit 70 and the coil spring 65. The load adjusting unit 70 includes the movable member, serving as a movable portion, 71 and the fixing bolt, serving as a fixing unit, 75. It is noted that while FIGS. 10A and 10B illustrate a front side of the cleaning unit 106, a rear side of the cleaning unit 106 is symmetrical with the front side similarly to the first embodiment.

The movable member 71 is provided at each of both ends in the wide direction W of the cleaning blade 60 and is swingable, i.e. movable, with respect to the case 53. The movable member 71 includes a bent portion 72 bent inward in the wide direction W and an engaging groove 74 is formed at a lower edge of the bent portion 72. The movable member 71 is provided swingably in a swing direction centering on a center axis 73 extending in the wide direction W. The movable member 71 is also fixed to the case 53 by a screw clamp of the fixing bolt 75. The bent portion 72 disposed on the movable member 71 and the project portion 64*a* disposed on the swing portion 61 facing the bent portion 72 compose a link portion 81. The link portion 81 is disposed at each widthwise end of the cleaning blade 60.

The coil spring 65 is a tension coil spring, is provided so as to link the engaging groove 74 of the movable member 71 and the engaging groove 64*b* of the pressure plate 64 (see FIG. 8) and is disposed at both ends of front and rear in the wide direction W of the cleaning blade 60. The first end portion 65*a* of the coil spring 65 is linked to the movable member 71 and the second end portion 65*b* is linked to the project portion 64*a* and urges the swing portion 61 with respect to the fixed movable member 71 such that the cleaning blade 60 is pressed against the surface of the photosensitive drum 51. The movable member 71 changes the length of the engaged coil spring 65 along with the swing. This arrangement makes it possible to adjust the pressing force of the cleaning blade 60 pressed against the surface of the photosensitive drum 51.

The movable member 71 is provided with a plurality of fixing holes of first and second fixing holes 71*a* and 71*b* formed corresponding to the plurality of fixing positions. The respective fixing holes 71*a* and 71*b* are defined to be able to fasten the movable member 71 to the case 53 by penetrating the fixing bolt 75 through the holes. In fastening the movable member 71 to the case 53 by the fixing bolt 75, the length of the engaged coil spring 65 is differentiated in a case of using the first fixing hole 71*a* and in a case of using the second fixing hole 71*b*. That is, the fixing bolt 75 can be disposed at each widthwise end and can fix the movable member 71 to the case 53 at a plurality of fixing positions.

Here, the plurality of fixing positions is disposed such that the pressing force of the cleaning blade 60 is differentiated by differentiating the relative position of the first end portion 65*a* and the second end portion 65*b* per fixing position for fixing the movable member 71 by the fixing bolt 75. This arrangement makes it possible to adjust the pressing force of the cleaning blade 60 pressed against the surface of the photosensitive drum 51 by changing the fixing holes 71*a* and 71*b* for fastening the fixing bolt 75 in the load adjusting unit 70. Note that while the case where the load adjusting unit 70 can adjust in two steps by using the two separate fixing holes 71*a* and 71*b* in the present embodiment, the present disclosure is not limited to such a case. For instance, three or more fixing holes may be provided or a long hole may be provided to be able to adjust continuously.

The present embodiment is configured such that a range in which the pressing force varies is differentiated when the fixing holes 71*a* and 71*b* fixing the movable member 71 is changed on the front load adjusting unit 70 and a rear load adjusting unit not illustrated in the same manner with the first embodiment. Thereby, the pressing force of the coil spring 65 pressing the cleaning blade 60 is changed at least to three different steps by changing the fixing position fixing the movable member 71 by the fixing bolt 75 in the widthwise each end. The fixing position of the fixing bolt 75 in each widthwise end is disposed accordingly.

As described above, the coil spring 65 is provided at both ends in the wide direction W of the cleaning blade 60 also in the cleaning unit 106 of the present embodiment. Therefore, it is possible to prevent the drum unit 50 from increasing in size by suppressing the load adjusting unit 70 of each coil spring 65 from increasing in size. Still further, it is possible to improve the resolution of adjustment of the pressing force of the cleaning blade 60 against the surface of the photosensitive drum 51 while suppressing the increase in size. Because the coil springs 65 are provided at the plurality of places, it becomes possible to set the resolution of adjustment more finely and to adjust to the preferable blade pressure more accurately as compared to a case of providing at one place.

Note that while the case where the coil springs 65 are disposed at the front and rear sides and the widthwise both ends of the cleaning blade 60 has been described in the drum unit 50 of each embodiment described above, the present disclosure is not limited to such a configuration. For instance, the coil springs 65 may be added to a widthwise center part or the like of the cleaning blade 60 to provide three or more places in total. Or, the coil spring 65 having no load adjusting unit may be provided.

Still further, while the case where the cleaning unit 6 is applied to the drum unit 50 has been described in the image forming apparatus 1 of the respective embodiments, the present disclosure is not limited to such arrangement and the cleaning unit 6 is applicable also to the transfer cleaning unit 48 (see FIG. 1) of the intermediate transfer belt, serving as an image bearing member, 44*b*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-083498, filed Apr. 24, 2018, which is hereby incorporated by reference herein in its entirety.

What is claimed is:

1. A cleaning unit, comprising:

a case;

a blade being in contact with a surface of an image bearing member to clean the surface of the image bearing member;

a swinging member provided swingably around a swinging axial line extended along a longitudinal direction of the blade and configured to support the blade to swing together;

a first coil spring provided on a first end side of the blade in the longitudinal direction and configured to pull the swing member to bring the blade into contact with the image bearing member;

a second coil spring provided on a second end side of the blade in the longitudinal direction and configured to pull the swing member to bring the blade into contact with the image bearing member; and a plurality of first engaging portions provided on one of the case or the swing member at the first end side of the blade in the longitudinal direction and configured to selectively engage one end side of the first coil spring at different positions with respect to the longitudinal direction of the blade so that a contact pressure of the blade against the image bearing member caused by the first coil spring is changed.

2. The cleaning unit according to claim 1, further comprising a plurality of second engaging portions provided on one of the case or the swing member at the second end side of the blade in the longitudinal direction and configured to selectively engage one end side of the second coil spring at different positions with respect to the longitudinal direction of the blade so that a contact pressure of the blade against the image bearing member caused by the second coil spring is changed.

3. The cleaning unit according to claim 2, wherein the plurality of first engaging portions are two first engaging portions composed of one first engaging portion located at a first position and another first engaging portion located at a second position which is different in position from the first position with respect to the longitudinal direction of the blade, and wherein the plurality of second engaging portions are two second engaging portions composed of one second engaging portion located at a third position and another second engaging portion located at a fourth position which is different in position from the third position with respect to the longitudinal direction of the blade.

4. The cleaning unit according to claim 3, wherein a contact pressure of the blade against the image bearing member caused by the first coil spring is a first contact pressure in a case where the one first engaging portion engages the first coil spring, wherein a contact pressure of the blade against the image bearing member caused by the first coil spring is a second contact pressure which is lower than the first contact pressure in a case where the other first engaging portion engages the first coil spring, wherein a contact pressure of the blade against the image bearing member caused by the second coil spring is substantially equal to the first contact pressure in a case where the one second engaging portion engages the second coil spring, and wherein a contact pressure of the blade against the image bearing member caused by the second coil spring is a third contact pressure which is higher than the first contact pressure in a case where the other second engaging portion engages the second coil spring.

5. The cleaning unit according to claim 3, wherein the case comprises an arm portion, wherein the arm portion is extended in the longitudinal direction of the blade at the first end side of the blade in the longitudinal direction, wherein the plurality of first engaging portions are provided on the arm portion, and wherein the first position is disposed closer to the second end side of the blade than the second position is, with respect to the longitudinal direction of the blade.

6. The cleaning unit according to claim 3, wherein the case comprises an arm portion, wherein the arm portion is extended in the longitudinal direction of the blade at the second end side of the blade in the longitudinal direction, wherein the plurality of second engaging portions are provided on the arm portion, and wherein the third position is disposed closer to the first end side of the blade than the fourth position is, with respect to the longitudinal direction of the blade.

7. The cleaning unit according to claim 2, wherein the plurality of second engaging portions are provided at a location exposed out of the case.

8. The cleaning unit according to claim 1, wherein the plurality of first engaging portions are provided at a location exposed out of the case.

* * * * *